US005431221A

United States Patent [19]

Roberts et al.

[11] Patent Number: 5,431,221

[45] Date of Patent: Jul. 11, 1995

[54] JAR ENHANCER

[75] Inventors: Billy J. Roberts; Arthur W. Neeks, both of Houston, Tex.

[73] Assignee: Houston Engineers, Inc., Houston, Tex.

[21] Appl. No.: 145,481

[22] Filed: Oct. 29, 1993

[51] Int. Cl.[6] ..... E21B 31/113

[52] U.S. Cl. ..... 166/73; 166/178; 175/321

[58] Field of Search ..... 166/178, 301, 73; 175/297, 299, 300, 321

[56] References Cited

U.S. PATENT DOCUMENTS

| | | | |
|---|---|---|---|
| 3,735,828 | 5/1973 | Berryman | 175/299 |
| 3,834,472 | 9/1974 | Perkins | 175/321 |
| 4,200,158 | 4/1980 | Perkins | 175/297 |
| 4,361,195 | 11/1982 | Evans | 166/178 X |
| 4,846,273 | 7/1989 | Anderson et al. | 166/178 |
| 5,086,853 | 2/1992 | Evans | 166/178 X |
| 5,174,393 | 12/1992 | Roberts et al. | 175/297 |
| 5,232,060 | 8/1993 | Evans | 166/178 X |

*Primary Examiner*—Roger J. Schoeppel
*Attorney, Agent, or Firm*—Vaden, Eickenroht, Thompson, Boulware & Feather

[57] ABSTRACT

There is disclosed a tool for enhancing the impact of a jar delivered to an object stuck in a well bore during both upward and downward jars to the stuck object. The tool includes a first tubular member having an lower end connectible to the tubular member of the jar on which the hammer is mounted and a second tubular member connectible to a well pipe string above it and arranged for reciprocation with respect to the first member to form an annular space between them. The space is divided into upper and lower chambers by means of seal rings disposed between the members and the spaces are filled with a compressible fluid which is compressed as the second tubular member is moved in either upward or downward directions.

8 Claims, 5 Drawing Sheets

FIG.4A
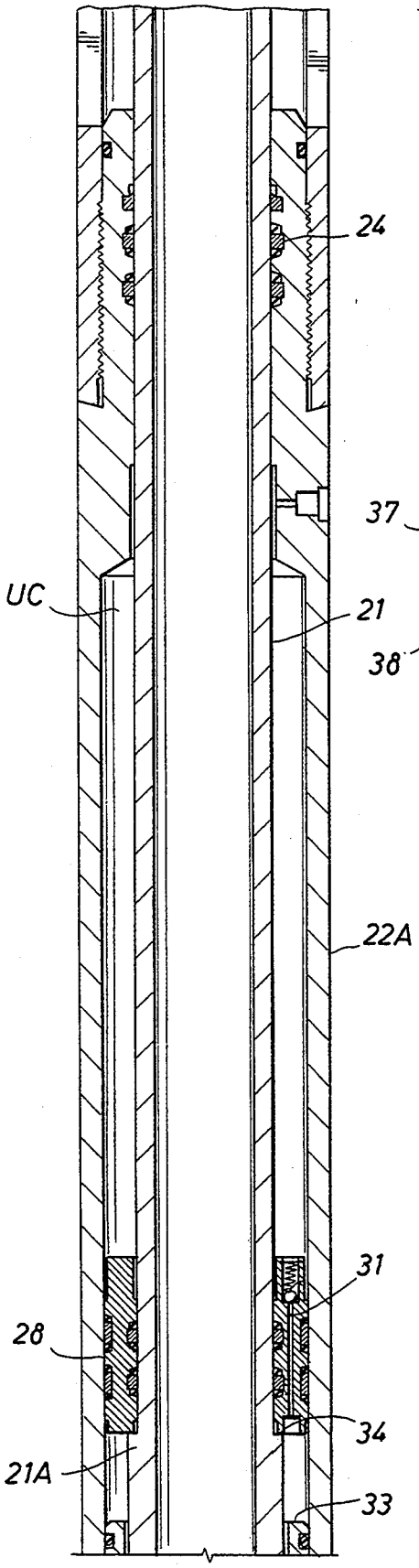
FIG.4B
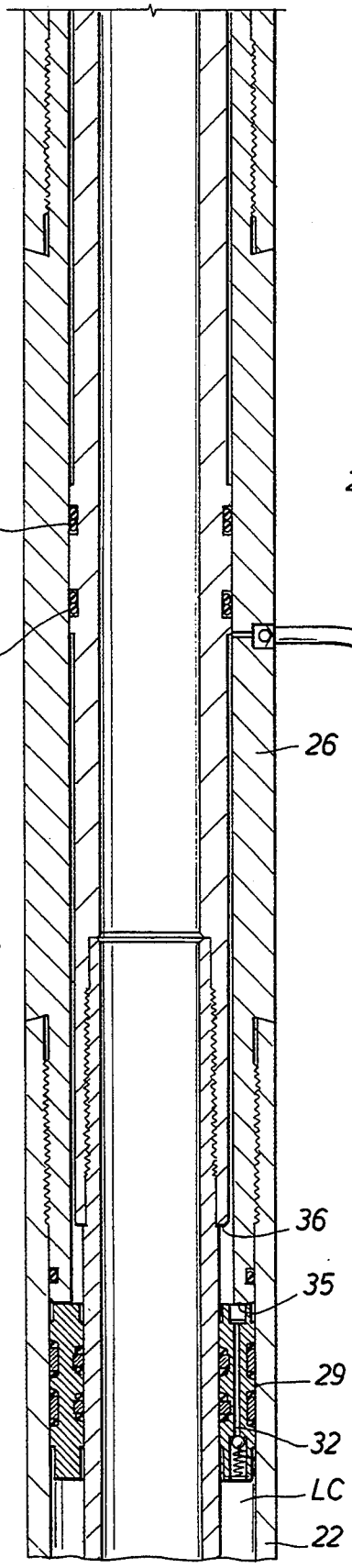
FIG.6
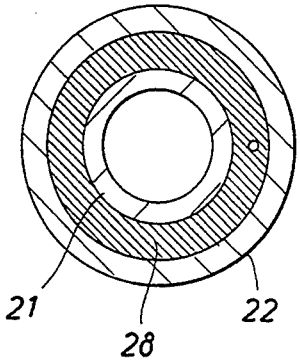
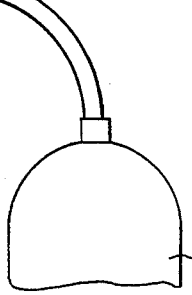
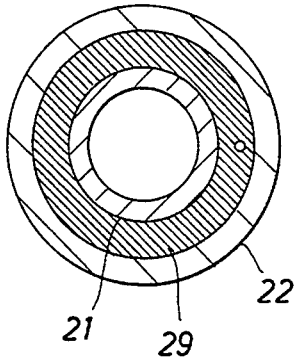
FIG.7

JAR ENHANCER

This invention relates generally to a tool for enhancing the impact of a jar delivered to an object stuck in a well bore. In one of its aspects, it relates to improvements in a tool of this type for enhancing the impacts of both upward and downward blows delivered to the object. In another of its aspects, it relates to a tool of this type having an improved arrangement for charging a chamber with a compressible fluid in which energy is stored for use in enhancing the impact of the jar.

As well-known in the art, a double-acting jar of the type described comprises a first tubular member or outer housing adapted to be connected to the object and a second tubular member or inner mandrel adapted to be connected as part of a pipe string and arranged telescopically of the first member or housing and having a hammer arranged to deliver an upward blow to an anvil on the housing in response to raising and a downward blow in response to lowering of the mandrel with respect to the housing. In an hydraulic jar, the mandrel carries a detent mechanism arranged to slide within a restricted bore of a chamber in the housing in which hydraulic fluid is contained. Thus, the detent mechanism is of such construction as to permit only limited flow past it, during its travel through the restricted bore, so as to build up tension in the mandrel as it is raised therethrough or compression therein as it is lowered therethrough. Consequently, as the detent moves out of the restricted bore, the mandrel and thus the hammer thereon is released to deliver either an upward or downward blow to the anvil of the housing and thus the stuck object to which the housing is connected.

As also well-known in the art, the object stuck in the well bore may be a "fish" onto which the lower end of the housing of the jar is lowered for connection thereto. Or, the object may be a lower part of the pipe string itself and thus already connected to the housing of the jar.

It is well-known in the art to enhance the impact of such jars by means of a so-called jar enhancer comprising a second tubular member or inner mandrel having an upper end adapted to be connected to the well pipe string above it, and a first tubular member or outer housing arranged telescopically of the mandrel member to form an annular space between them and having a lower end adapted to be connected to the mandrel member of the jar (or to drill collars above the jar) for raising and lowering therewith. More particularly, in one embodiment of a jar enhancer the space may be filled with an elastic medium, such as a compressible fluid which may be a gas, such as nitrogen, or a compressible liquid, such as silicone, and a piston on the mandrel within the space may sealably slide with respect to the bore of the housing to form a pressure chamber on one side in which the fluid is compressed to store energy in the space above it as the mandrel is raised, in the case of an upward jar, or below it as the second member is lowered, in the case of a downward jar. Alternatively, the elastic medium may be a stack of springs, such as Bellville springs, contained within the space in a position to be compressed to store energy therein upon raising or lowering of the mandrel.

In a jar, the second tubular member or mandrel on which the hammer is carried has a certain amount of "free" travel following movement of the detent out of the restricted bore and as the hammer moves to strike the anvil. In jar enhancers prior to the invention disclosed in U.S. Pat. No. 4,846,273, the piston or ring on the second tubular member or mandrel conventionally had a certain amount of "free" travel before it was moved into a position to accumulate or store energy.

In accordance with U.S. Pat. No. 4,846,273, however, it was proposed to provide a jar enhancer having an initial "free" travel at least as great as that of the jar, thereby insuring that accumulated energy was applied to the stuck object. Although representing a substantial advance over the prior art in this respect, the jar enhancer of the aforementioned patent is of relatively complex construction and expensive to manufacture, including a large number of parts which cause it to be quite long and difficult to service and repair. Also, at least in the version of the jar enhancer of FIGS. 6 and 7 of U.S. Pat. No. 4,846,273, the piston moving in the bore of the housing is of necessarily complex construction to enable it to move in the opposite direction through the bore following the jarring event.

An object of this invention is to provide a double-acting jar enhancer of this general type which overcomes these and other problems with those of the prior art in that it is of simpler and less expensive construction.

In double-acting, jar enhancers of this type, it has been the practice to fill the chamber with compressible fluid through a port in the outer of the tubular members having a one-way check valve to which a container of compressed fluid is connected and then removed upon filling. This then requires that the fluid in the container be charged to a pressure greater than that to which the space is to be charged. Since the pressure of the charged fluid in the container is sometimes less than that to which the chamber is to be charged, such as 800 or 900 p.s.i., this requires a large and expensive source.

Another object of this invention is to provide a double-acting jar enhancer of the type described in which the chambers may be charged with a container of compressible fluid at less pressure than that to which the jar enhancer is to be charged and thus normally at less expense.

These and other objects are accomplished, in accordance with the illustrated embodiment of the invention, by a tool of the type described in which upper and lower longitudinally spaced rings are disposed within the annular space for longitudinally sliding with respect to the tubular members, and wherein the first member or housing adapted to be connected to the second tubular member or mandrel of the jar has an upper shoulder engagable with the upper ring to limit its movement in a downward direction and a lower shoulder engagable with the lower ring to limit its movement in an upward direction, and the second member or mandrel adapted to be connected to the well string above it has an upper shoulder engagable with the upper ring to raise the upper ring with it, upon raising of the second tubular member, and a lower shoulder engagable with the lower ring to lower the lower ring with it, upon lowering of the second tubular member. More particularly, upper and lower sliding seal rings are provided between the first and second tubular members along equal diameter portions of the second tubular member to form an upper chamber within the space above the upper ring and a lower chamber within the space below the lower ring, and the upper and lower chambers contain an elastic medium which is compressed, upon raising of the second member to enhance an upward jar, and upon lowering of the second member to enhance the impact of a downward jar. Preferably, the shoulders on the first member are essentially adjacent the upper and lower seal rings when said second tubular member is in a neutral position.

More particularly, and as shown in the illustrated embodiment of the invention, the upper and lower rings are seal rings or pistons which are sealably slidable with respect to equal diameter portions of each of the tubular members to form with the sliding seals upper and lower pressure chambers respectively above and below the upper and lower seal rings. Thus, with the upper and lower chambers filled with a compressible fluid, raising of the second member will compress the fluid in the upper chamber to enhance an upward jar and lowering of the second member will compress the fluid in the lower chamber to enhance the impact of a downward jar.

Also, there is a check-valve-controlled port in the outer member or housing through which compressed fluid may be introduced between the members intermediate the seal rings, and each seal ring has valve means therein permitting flow in a direction to admit fluid into but not out of said chambers. More particularly, in the preferred and illustrated embodiment of the invention, seal members are carried by the inner tubular member or mandrel for sealably engaging the outer member or housing on opposite sides of the port in the neutral position of the members whereby the fluid is drawn into one chamber in the space between the seal members and each ring, as the inner member or mandrel is moved from the neutral position in either direction, and a one-way check valve is provided in each ring permitting flow only from the other chamber into the upper or lower chamber, so that, upon closing of the valve-controlled source, and movement of the mandrel in opposite directions, such fluid is forced from said other chamber and through each of said one-way valve member into said chambers. Thus, the pressure of the fluid in the one chamber may be further increased upon return of the mandrel to its neutral position, opening of the valve-controlled source, movement of the mandrel in one direction, closing of the valve-controlled source and movement of the mandrel in the opposite direction. As will be described, the mandrel may be reciprocated in a manner to charge both chambers simultaneously.

In the drawings, wherein like reference characters are used throughout to designate like parts:

FIGS. 4A and 4B are longitudinal sectional views of upper and lower intermediate portions of the jar enhancer, with a container or bottle of pressurized fluid connected to the fill port in the outer tubular member or housing, and with the inner tubular member or mandrel raised to begin drawing such fluid into a charging chamber between the inner and outer tubular members;

Figure 1A:
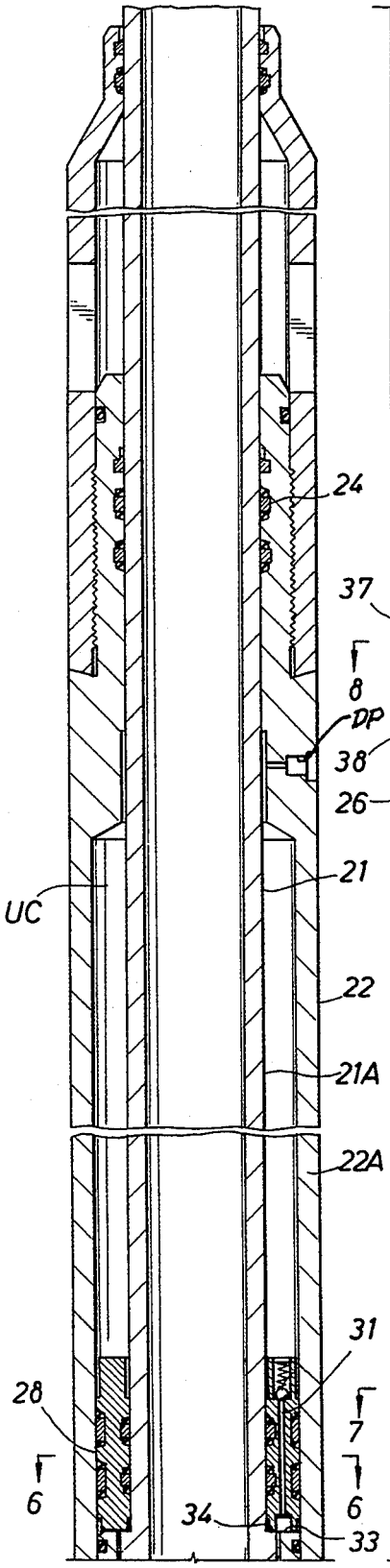
FIGS. 1A, 1B and 1C are longitudinal sectional views of the upper, intermediate and lower portions of a jar enhancer constructed in accordance with the present invention, and with the tubular members disposed in a neutral position prior to the initiation of either an upward or downward jar.
Figure 1B:
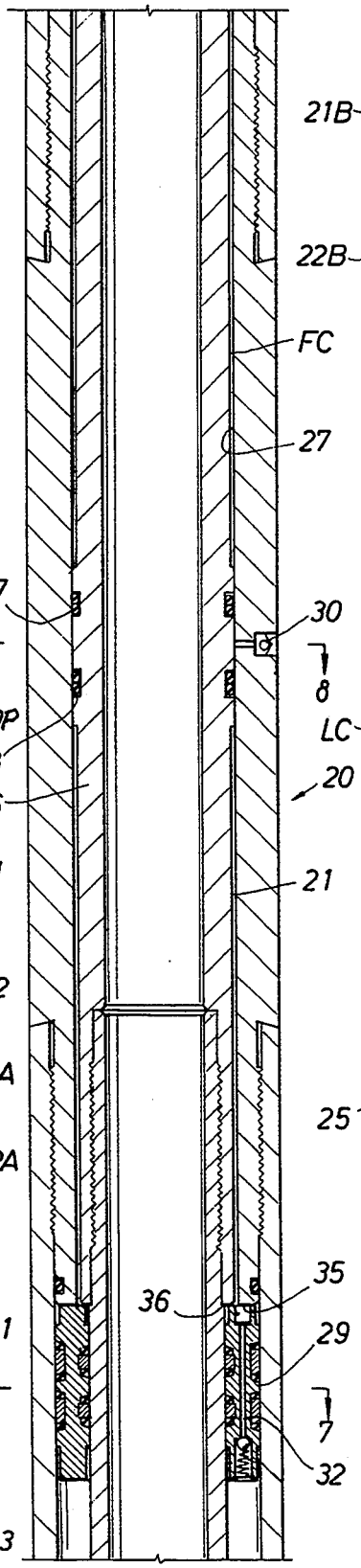
Figure 5A:
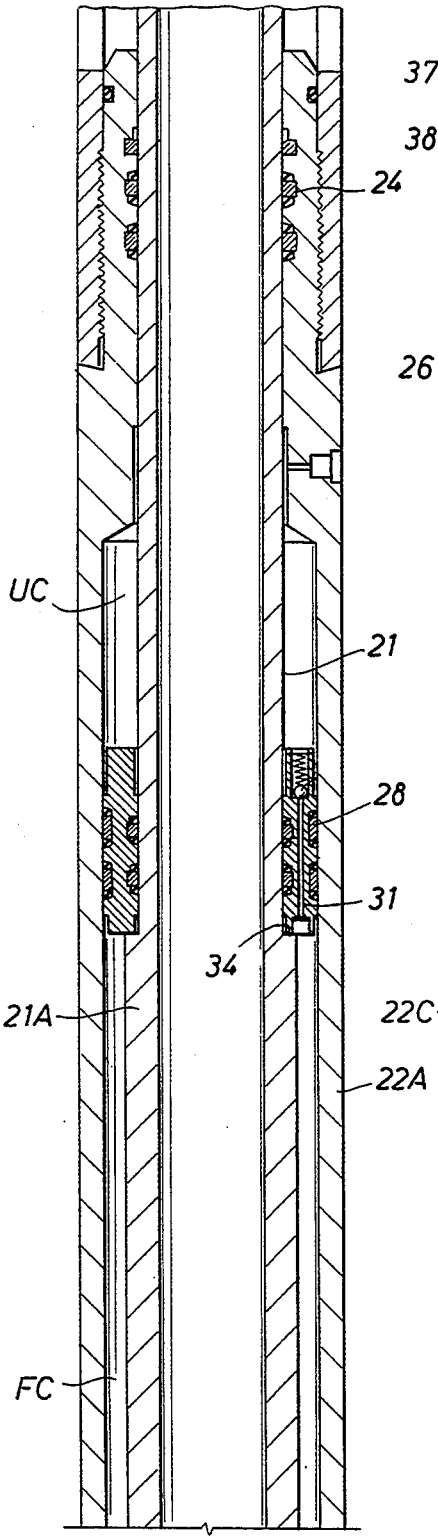
Figure 5B:
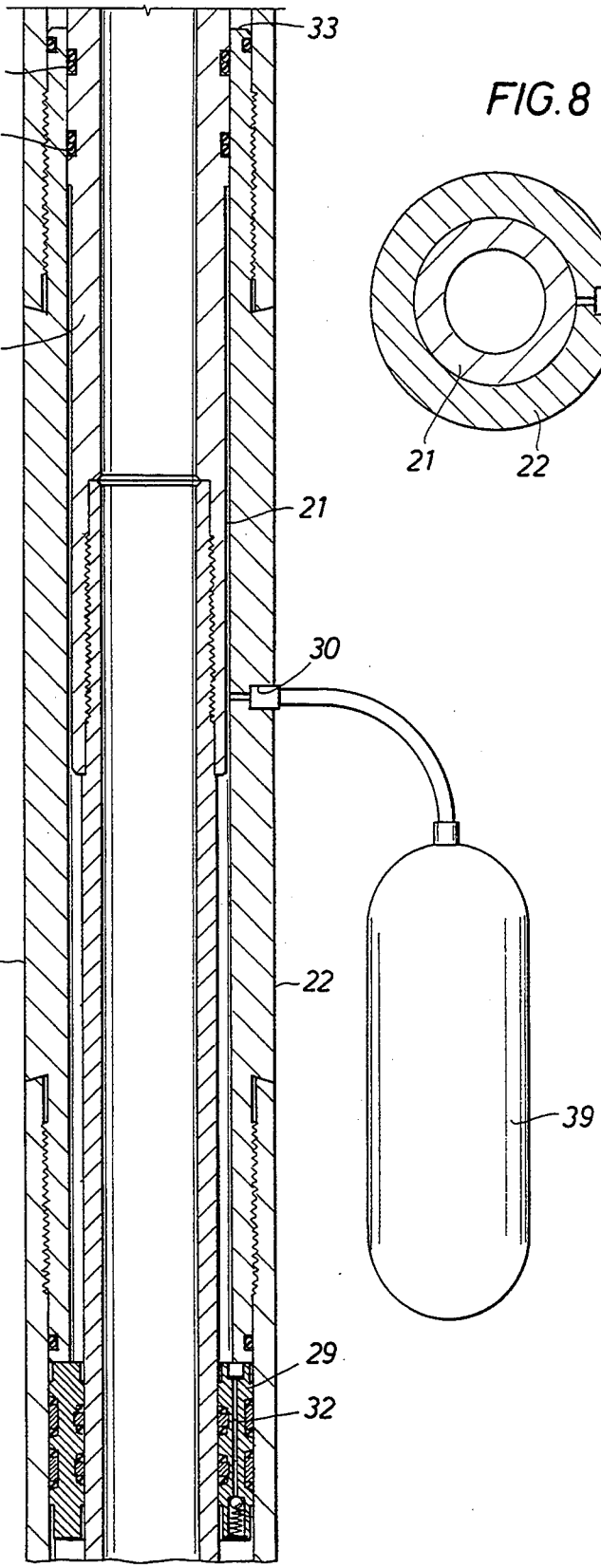
Figure 8:
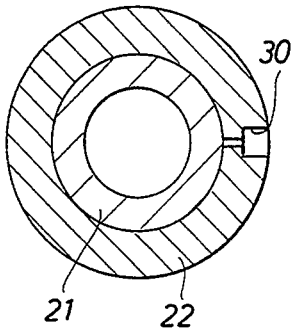

FIGS. 5A and 5B are views similar to FIGS. 4A and 4B, but with the mandrel raised to its uppermost position, and upon closing of the valve to the container preparatory to lowering of the mandrel member in order to force the compressed fluid through a check valve in the lower seal ring into the lower chamber; and FIGS. 6, 7 and 8 are cross-sectional views of the jar enhancer, as seen along broken lines 6—6, 7—7, and 8—8 of FIGS. 1A and 1B.

With reference now to the details of the drawings, the over-all jar enhancer, which is indicated in its entirety by reference character 20, is shown to comprise a second tubular member or mandrel 21 having an upper end adapted to be connected to the lower end of a well pipe string (not shown) above it, and a first tubular member or housing 22 surrounding the mandrel and vertically reciprocable with respect to it to form an annular space between the members and having a lower end adapted to be connected to the mandrel (not shown) of a jar on which the hammer is mounted. As previously described, the mandrel is, in turn, vertically reciprocable with respect to the housing of the jar adapted to be connected to the stuck object and on which the anvil is mounted.

The jar itself may, of course, be constructed in a well-known manner, and thus need not be described herein, it being sufficient for the purposes of the present application to describe the hammer of the jar as being raised and lowered with the first tubular member or housing of the jar enhancer.

Although vertically reciprocable with respect to one another, the tubular members 21 and 22 of the jar enhancer are held against rotation with respect to one another, as by means of a drive mechanism of some type above it. Thus, the outer tubular member is caused to rotate with the inner tubular member and thus the pipe string above it, such that similar rotation may be imparted to parts of the jar below the jar enhancer.

The upper portion of the tubular member 21 is sealably slidable within packing 24 carried about the upper end of the tubular member 22, while the lower portion of the tubular member 21 is sealably slidable within packing 25 carried about an intermediate portion of the tubular member 22. These portions of the tubular members, and thus the packings 24 and 25, have equal sealing diameters.

The outer tubular member 22 is made up of an upper tubular section 22A on which the packing 24 is carried, a lower tubular section 22B on which the packing 25 is carried, and a connector 22C threadedly connecting the upper and lower tubular sections 22A and 22B to one another. A lowermost section 22D of the tubular member 22 is connected to the lower end of tubular section 22B and is adapted for connection to the upper portion of the pipe string from which the jar is suspended.

The inner tubular member 21 is, in turn, comprised of an upper tubular section 21A which is slidably received within the packing 24 and whose upper end is adapted to be connected to the pipe string above it, and a lower tubular section 21B threadedly connected to section 21A and slidably received within the packing 25. The upper section 21A has an enlarged diameter portion 26 which fits relatively closely within the inner diameter 27 of the connector 22C of the tubular member 22. Upper and lower pistons or seal rings 28 and 29 are disposed within the annular space, respectively, above and below the enlarged diameter portion 26 of member 21 and inner diameter 27 of member 22 so as to divide the annular space into an upper pressure chamber UC between the upper piston 28 and the upper packing 24, a lower pressure chamber LC between the lower piston 29 and the packing 25, and a fill or charging chamber FC intermediate the pistons 28 and 29.

A one-way check-valve-controlled fill port 30 is formed in the connector 22C, and one-way check-valve-controlled passageways 31 and 32 are formed through the upper and lower pistons 28 and 29, respectively, whereby, as will be described to follow in connection with FIGS. 4A and 4B and 5A and 5B, the chambers UC and LC may be filled with a compressible fluid from a suitable source connected to the fill port 30. More particularly, the valve-controlled port 30 permits flow into the chamber FC, but not out of the chamber, while the valve-controlled passageway through piston 28 permits flow into the upper chamber UC, but not out of it, and the valve-controlled passageway through lower piston 29 permits flow into the lower chamber LC but not out of it. Thus, in any case, with the chambers filled, upward movement of the piston 28 with respect to the tubular member 22 will compress fluid above it, while downward movement of the piston 29 with respect to the tubular member 22 will compress fluid in the lower chamber LC beneath it.

Figure 1C:
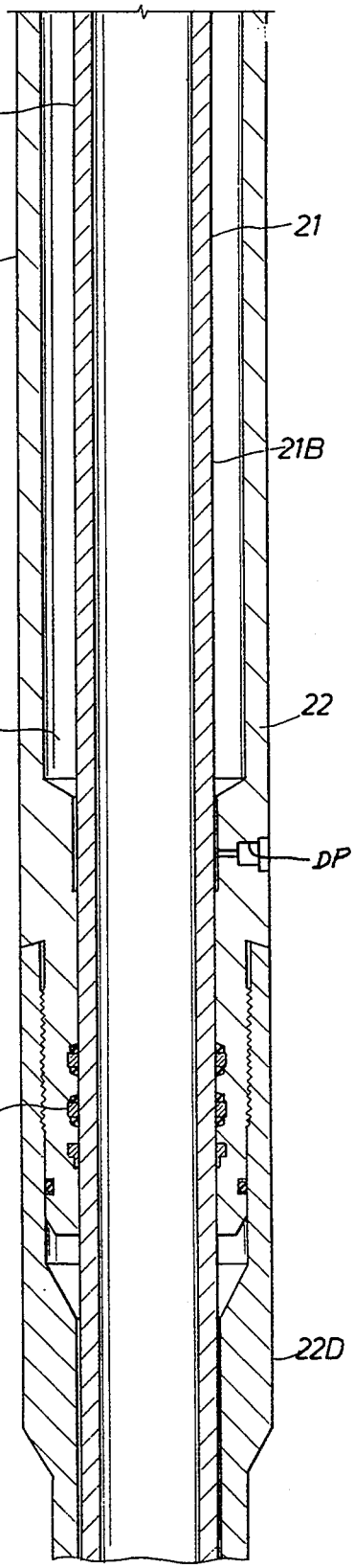

In the neutral position of the jar enhancer shown in FIGS. 1A, 1B and 1C, the upper piston 28 is supported on a shoulder 33 on the upper end of the connector 22C and an adjacent shoulder 34 formed at the upper end of the enlarged diameter portion 26 of the tubular section 21A, in which position it is held by the lightly compressed fluid in the chamber UC. The lower piston 29, on the other hand, is forced upwardly by the lightly compressed fluid in the lower chamber LC into engagement with a downwardly facing shoulder 35 about the lower end of the connector 22C and a downwardly facing shoulder 36 on the lower end of the enlarged diameter portion 26 of the tubular section 21A. As shown, the shoulders on the connector and enlarged diameter portion 26 are laterally adjacent to one another when the jar enhancer is in its neutral position so as to have no "free" movement whatsoever.

Figure 2A:
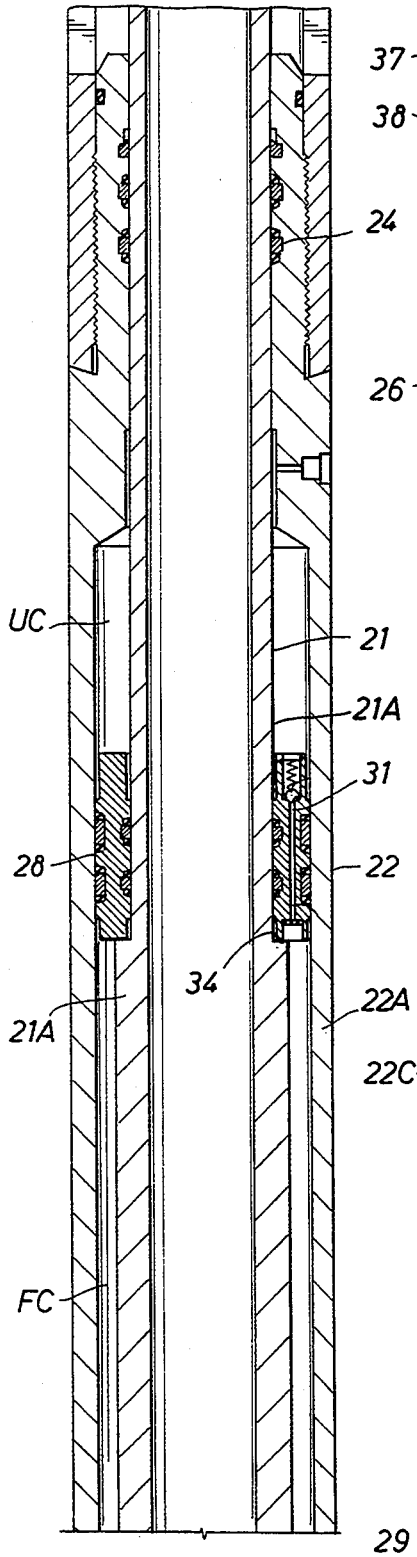
FIGS. 2A, 2B and 2C are similar views of the jar, but during raising of the inner tubular member or mandrel in order to impart an upward blow to an object stuck in the well bore beneath the jar connected below the jar enhancer.
Figure 2B:
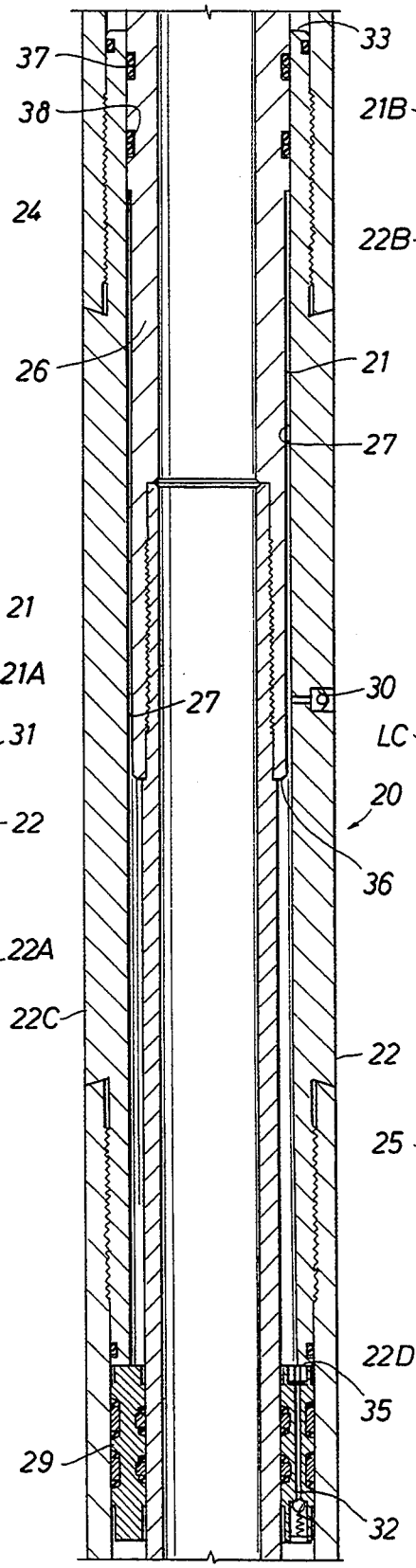
Figure 2C:
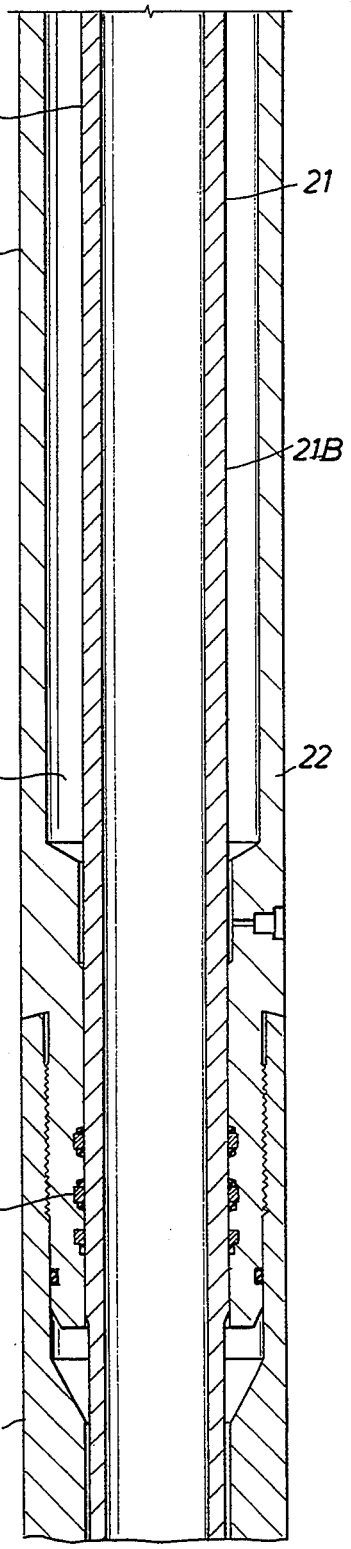
Figure 3A:
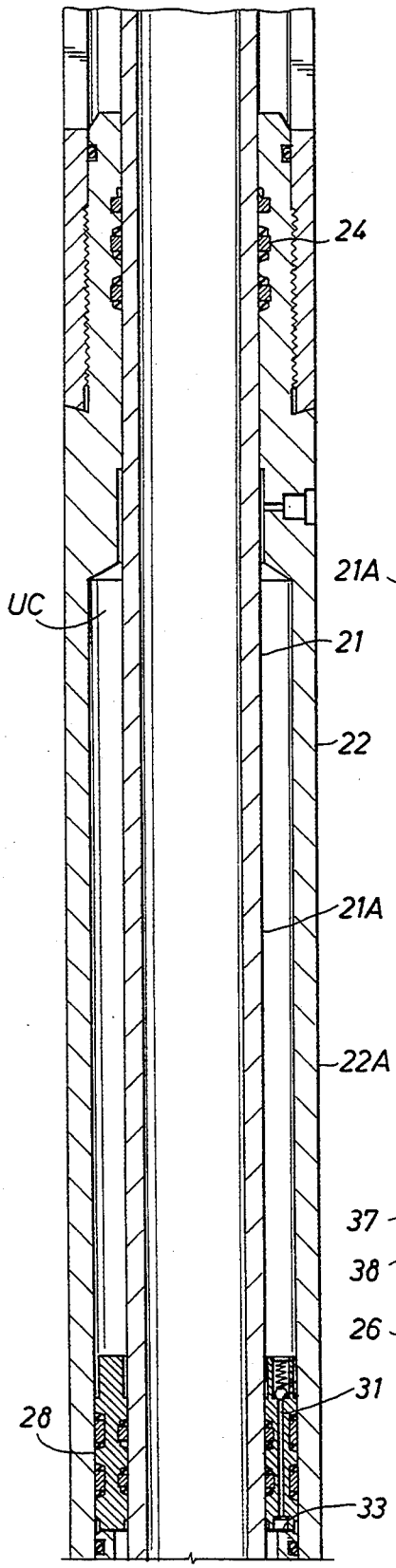
FIGS. 3A, 3B and 3C are further similar views of the jar enhancer, but during lowering of the inner tubular member or mandrel in order to impart a downward blow to the object stuck in the well bore.
Figure 3B:
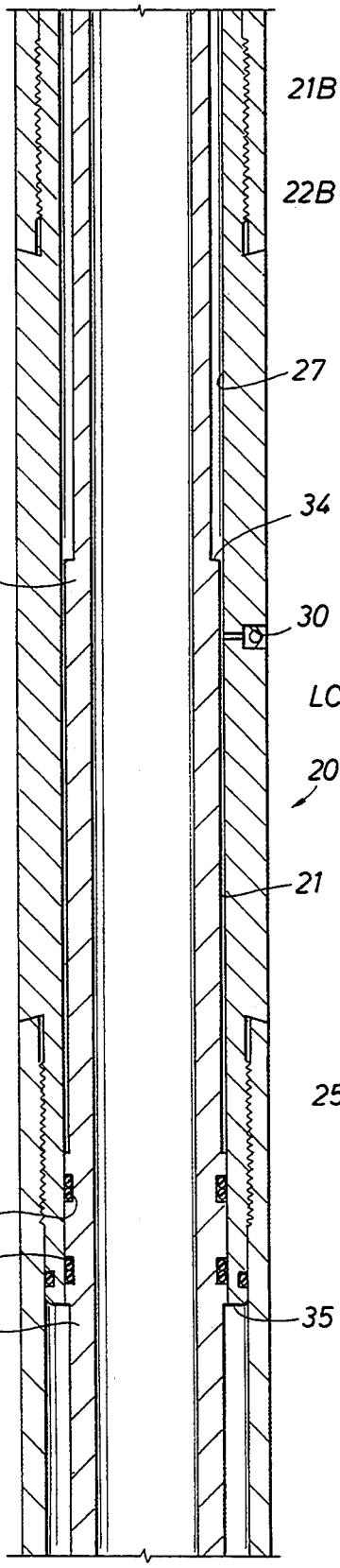
Figure 3C:
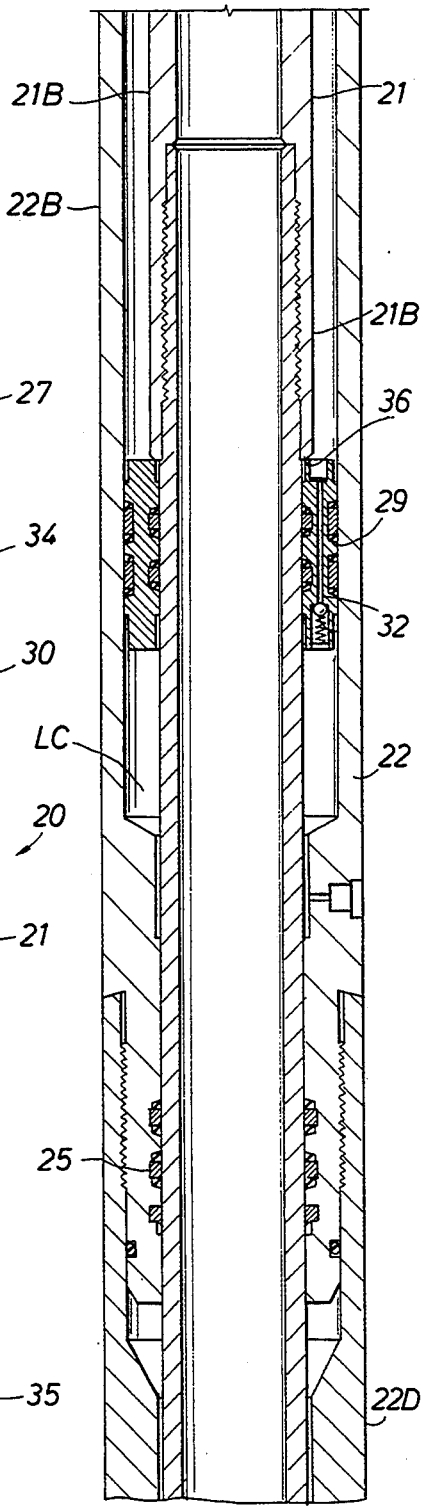

In the event an upward jar is to be applied to the stuck object, the upper end of the pipe string and thus the tubular member 21 of the jar enhancer is raised to the position shown in FIGS. 2A, 2B and 2C. As this occurs, the seal ring 28 is raised with the tubular section 21A to a limited upper position, which may be determined by the stroke of the drive system above it, to further compress the fluid in the upper chamber UC. However, since the pistons 28 and 29 seal about equal diameter portions of the inner tubular member 21 equal to the diameter portions slidable in the packings 24 and 25, there is no counteracting force due to compression of the fluid in the lower chamber LC. At the same time, raising of the piston 28, while the piston 29 remains stationary, will create a vacuum in the fill chamber FC, which actually adds to the accumulation of energy in the upper chamber UC. In any case, when the jar and its hammer are released for "free" travel into engagement with the anvil, the energy accumulated in the upper chamber UC will enhance the impact of the jar by virtue of the force which the accumulated energy exerts upwardly on the second tubular member 22 connected to the tubular member on which the hammer of the jar is mounted.

Conversely, downward movement of the tubular member 21 with respect to the tubular member 22, in order to initiate a downward jar, will cause the seal ring or piston 29 to move downwardly with the tubular member 21 to further compress fluid in the lower chamber LC. Again, since the sealing diameter of the upper piston 28 with respect to the upper tubular section 21A of the tubular member 21 is the same as that of the packing 24, there is no counteracting force created in the upper chamber UC, and the only effect of the fill chamber FC is to produce a vacuum which actually adds to the energy created in the lower chamber LC. Thus, when the downward jar moves out of its restriction to impact the anvil, the energy accumulated in the lower chamber LC further enhances the jarring impact.

As also shown, parts DP are formed in the housing to permit fluid to be drained from each of the upper and lower pressure chambers.

Turning now to a detailed description of the manner in which the chambers UC and LC are charged with a compressible fluid, and as previously described in broad terms, a pair of seal rings 37 and 38 are carried about the enlarged diameter portion of the tubular section 21 of the inner tubular member for disposal on opposite sides of the inner end of the port 30 when the inner and outer tubular members of the jar enhancer are in the neutral position shown in FIG. 1B. With reference now to FIGS. 4A, 4B, 5A and 5B, and assuming that, prior to use of the tool, neither of the chambers UC and LC has been charged, a bottle or container 39 of a compressible fluid is connected to the outer end of the port 30 with the valve on its outlet in position to be opened by the valve controlling the port 30. Thus, with the inner and outer tubular members in their neutral position, the compressed fluid will enter the small annular space between the seal rings 37 and 38.

In order to initially charge the lower chamber LC, the inner tubular member is raised so as to move the lower seal ring 38 above the inner end of the port 30 so that the compressible fluid enters the charging chamber above the seal ring or piston 29. As the inner tubular member continues to be raised from the position of FIGS. 4A and 4B to the position of FIGS. 5A and 5B, it continues to suck or withdraw compressed fluid from the container into the charging chamber above the seal ring 29 until it reaches its limited upper position, as determined, for example, by interengagable shoulders in the drive system above the jar enhancer. As the inner tubular member is raised, the seal ring 28 is also raised so as to compress any fluid above it. However, as previously noted, that chamber has not been filled with gas, so that the effect is negligible.

As previously described, the seal ring 29 has one or more passageways 32 formed therethrough having a check valve for preventing flow upwardly therethrough, but permitting flow downwardly therethrough. Thus, as the inner tubular member is raised, the valve in passageway 32 remains closed. On the other hand, when the tubular member is lowered from its upper position of FIGS. 5A and 5B, the fluid drawn into the charging chamber intermediate the seal rings 38 and 29 is compressed so as to force the valve in port 32 open and thus initially charge the lower chamber LC with compressible fluid. It may be assumed, for purposes of this description, that the upper chamber LC has not been charged with a compressible fluid. If there is any compression of fluid in the charging chamber between the seal ring 28 and the seal ring 37, the compressed fluid is free to pass upwardly into the upper chamber. Since the chamber UC has not been charged, any compression of fluid above the seal ring 37 is negligible. Likewise, lowering of the inner tubular member from the position of FIGS. 5A and 5B back to the neutral position of FIG. 1B has only negligible effect insofar as the pressure of the fluid above the seal ring 37 is concerned.

In order to increase the pressure of the fluid in the lower chamber to the desired value, this raising and lowering of the inner tubular member may be repeated so as to cause successive charges of compressible fluid to be passed through the valve in passageway 32 into the lower chamber LC. At this point and before lowering the inner tubular member, the valve at the outlet of the container 39 is closed so that the compressed fluid in the charging chamber is directed through the valve in the seal ring 29 into the lower chamber. The effect, of course, is to multiply the pressure of the compressed gas received from the bottle. Then, of course, during each subsequent charging operation, the valve at the outlet of the nitrogen bottle or container is opened to admit a further charge of compressed fluid to the charging chamber and then closed during lowering of the inner tubular member.

In order to then charge the upper chamber UC, the foregoing procedure is reversed. That is, the inner tubular member is lowered from its neutral position in order to permit compressed fluid to flow into the charging chamber from the container, and then, upon closing of the outlet of the container, raised to force that fluid past the check valve in the upper seal ring 28.

It is also contemplated that both the upper and lower chambers may be charged simultaneously. Thus, the inner tubular member may be alternately stroked to its limited upper and lower positions. One shortcoming of this procedure, however, is that it does not take advantage of the maximum volume capacity of the charging chamber. That is, actual compression of the fluid during either a downward or upward stroke of the inner tubular member will only take place after the seals 37 and 38 pass the inner end of the port 30 in the direction of charge.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool for enhancing the impact delivered to an object stuck in a well bore by means of a jar having a first tubular member connected to the object and a second tubular member having a hammer arranged to deliver an upward blow to an anvil on the first member in response to raising and a downward blow in response to lowering of the second tubular mandrel member with respect to the first member said tool comprising a first tubular member having a lower end adapted to be connected to said second tubular member of the jar for raising and lowering therewith, a second tubular member vertically reciprocable with respect to the first member to form an annular space between them and having an upper end adapted to be connected to a well pipe string above it, upper and lower longitudinally spaced rings within the annular space longitudinally slidable with respect to the tubular members, said first member having an upper shoulder engagable with the upper ring to limit its movement of the upper ring in a downward direction and a lower shoulder engagable with the lower ring to limit movement of the lower ring in an upward direction, said second member having an upper shoulder engagable with the upper ring to raise the upper ring with it, upon raising of the second member, and a lower shoulder engagable with the lower ring to lower the lower ring with it, upon lowering of the second member, and means forming upper and lower sliding seals between the first and second tubular members along equal diameter portions of the second tubular member to form an upper chamber within the space above the upper ring and a lower chamber within the space below the lower ring, the upper chamber containing an elastic medium which maintains the upper ring engaged with the upper shoulder of the first member and which is compressed, upon raising of the second member, to enhance an upward jar, and the lower chamber containing an elastic medium which maintains the lower ring engaged with the first member and which is compressed, upon lowering of the second member, to enhance the impact of a downward jar, the upper and lower shoulders of the second member being so spaced as to maintain substantial engagement with the upper and lower rings, respectively, is the neutral position of the second member.

2. As in claim 1, wherein the upper and lower shoulders on the second tubular member are essentially vertically adjacent the upper and lower ends of the upper and lower seal rings when said second tubular member is in a neutral position.

3. As in claim 1, wherein the second member is reciprocable within the first member.

4. A tool for enhancing the impact delivered to an object stuck in a well bore by means of a jar having a first tubular member connected to the object and a second tubular member having a hammer arranged to deliver an upward blow to an anvil on the first member in response to raising and a downward blow in response to lowering of the second tubular mandrel member with respect to the first member said tool comprising a first tubular member having a lower end adapted to be connected to said second tubular member of the jar for raising and lowering therewith, a second tubular member vertically reciprocable with respect to the first member to form an annular space between them and having an upper end adapted to be connected to a well pipe string above it, upper and lower longitudinally spaced seal rings within the annular space and sealably slidable with respect to equal diameter portions of each of the tubular members, said first member having an upper shoulder engagable with the upper ring to limit movement of the upper ring in a downward direction and a lower shoulder engagable with the lower ring to limit movement of the lower ring in an upward direction, said second member having an upper shoulder engagable with the upper ring to raise the upper ring with it, upon raising of the second member, and a lower shoulder engagable with the lower ring to lower the lower ring with it, upon lowering of the second member, and means forming upper and lower sliding seals between the first and second tubular members along the diameter portion of the first tubular member to form an upper pressure chamber within the space above the upper seal ring and a lower pressure chamber within the space below the lower seal ring, whereby, with the upper and lower chambers filled with a compressible fluid which maintains the upper ring engaged with the upper shoulder of the first member and the lower ring engaged with the lower shoulder of the first member, raising of the second member will compress the fluid in the upper chamber to enhance an upward jar and lowering of the second member will compress the fluid in the lower chamber to enhance the impact of a downward jar, the upper and lower shoulders of the second member being so spaced as to maintain substantial engagement with the upper and lower rings, respectively, is the neutral position of the second member.

5. As in claim 4, wherein the upper and lower shoulders on the second tubular member are essentially vertically adjacent the upper and lower ends of the upper and lower seal rings when said second tubular member is in a neutral position.

6. As in claim 4, wherein means formed in the outer member of the first and second members through which fluid may be introduced between the members intermediate the seal rings, and each seal ring has means therein permitting flow in a direction to admit fluid into but not out of said chambers.

7. As in claim 4, wherein the second member is reciprocable within the first member.

8. As in claim 4, including means by which the chamber may be charged with a compressible fluid, comprising a valve controlled port in the outer tubular member to which a valve-controlled source of such fluid may be connected, seal members carried by the inner tubular member for sealably engaging the outer member on opposite sides of the port in a neutral position of the members whereby said fluid is drawn into another chamber in the space between the seal members and each ring as the second member is moved from said neutral position in either direction, and valve means in the upper and lower rings permitting flow only from said other chamber into the upper or lower chamber, so that, upon closing of the valve-controlled source, and movement of the second member in opposite directions, such fluid is forced from said other chamber and through each of said valve means into said chambers, the pressure of the fluid in each chamber being further increased upon return of the second member to its neutral position, opening of the valve-controlled source, movement of the second member in one direction, closing of the valve-controlled source and movement of the second member in the opposite direction.

* * * * *

UNITED STATES PATENT AND TRADEMARK OFFICE

CERTIFICATE OF CORRECTION

PATENT NO. : 5,431,221

DATED : July 11, 1995

INVENTOR(S) : Roberts, et al

It is certified that error appears in the above-indentified patent and that said Letters Patent is hereby corrected as shown below:

On the title page, item [75] Inventors: "Neeks" should read --Meeks--.

Signed and Sealed this

Fourteenth Day of November, 1995

*Attest:*

*Attesting Officer*

BRUCE LEHMAN

*Commissioner of Patents and Trademarks*